United States Patent [19]

Kabadi et al.

[11] 4,335,760

[45] Jun. 22, 1982

[54] APPARATUS FOR HOLDING A SYRINGE AND FILLING AN AMPULE

[75] Inventors: Balachandra N. Kabadi, South River; Michael S. Farkas, Spotswood, both of N.J.

[73] Assignee: E. R. Squibb & Sons, Inc., Princeton, N.J.

[21] Appl. No.: 194,309

[22] Filed: Oct. 6, 1980

[51] Int. Cl.[3] ..... B65B 3/04

[52] U.S. Cl. ..... 141/129; 141/258; 74/105; 222/43; 222/44

[58] Field of Search ..... 222/43, 44, 181, 287, 222/309, 386, 386.5, 340; 53/131; 74/102, 104, 105; 92/129; 141/18–27, 329, 330, 250–284, 129, 130

[56] References Cited

U.S. PATENT DOCUMENTS

| | | | |
|---|---|---|---|
| 1,513,782 | 11/1924 | Riess | 74/105 |
| 3,097,763 | 7/1963 | Aluotto | 222/309 |
| 3,205,920 | 9/1965 | Cozzolli et al. . | |
| 3,731,716 | 5/1973 | Darish . | |
| 3,807,464 | 4/1974 | Pitesky | 141/258 |
| 4,204,469 | 5/1980 | Johnson | 53/131 |

OTHER PUBLICATIONS

Oceanography International Corporation; Aug. 1978, Herot Reprint from Adhesives Age, May 1980, "What You Should Know About Engineered Dispensing Stations for Adhesives," Tridak Model 200V.

*Primary Examiner*—Houston S. Bell, Jr.
*Attorney, Agent, or Firm*—Lawrence S. Levinson; Sanford J. Asman

[57] ABSTRACT

An apparatus for holding a syringe and filling ampules is described. The apparatus is comprised of a housing having a base and a vertical support member. A syringe holder is affixed to the vertical support member in a manner which permits the syringe holder to slide up and down between two limits on the vertical support member.

The apparatus operates by first lowering the syringe holder downward to place the needle of the syringe (in the holder) into an ampule, in response to the downward movement on the device's handle. Further downward movement of the handle causes material from the syringe, such as a viscous liquid, to be dispensed into the ampule.

10 Claims, 2 Drawing Figures

APPARATUS FOR HOLDING A SYRINGE AND FILLING AN AMPULE

BACKGROUND OF THE INVENTION

The dispensing apparatus for liquid disclosed by Cozzoli et al. in U.S. Pat. No. 3,205,920 is an elongated filling nozzle assembly for an apparatus for charging an upright container with liquid, the filling nozzle assembly comprising a discharge tube having a lateral discharge opening adjacent to its bottom end, the bottom end of said tube being completely closed, an outer valve sleeve telescopically ensheathing said tube and longitudinally slidable thereon, means to support the nozzle with its longitudinal axis vertical.

Darish in U.S. Pat. No. 3,731,716 discloses a drawback slide valve for liquid charging apparatus which delivers a measured quantity of liquid into a container. The drawback slide valve has a hollow spindle with two sections of different external diameters. The spindle has two lateral openings in the spindle which communicate with the bore or hollow interior of the spindle. The bore is closed by a plug between the lateral openings. The spindle is partially enclosed by a sleeve which is slidable on the spindle.

SUMMARY OF THE INVENTION

The filler transfers liquids from bulk loaded in a syringe into small ampules, tubes or other containers without contamination. The filler is particularly well adapted for dispensing of viscous liquids into smaller containers. A heavy duty plunger squeezes viscous liquid out of a vertically held syringe directly into the ampules which are inserted in the turntable. The turntable and syringe are preferably removable. The syringe may be made from a disposable material.

The syringe is filled with liquid to be dispensed into the ampules. The ampules are placed in a turntable (carousel) holder. The syringe is held (or clamped) on the filler housing so that the syringe needle is above the top of the ampule to be filled. Ampules are filled one at a time. The turntable may be rotated by hand and is positioned, guided or held in place by a spring loaded ball.

The liquids to be dispensed by the apparatus of the invention include not only viscous or semisolid drugs in their liquid state but also other viscous fluids as well as non-viscous fluids such as chemicals or other compounds. For example, oils, resins, glues, creams, lotions and solvents.

The apparatus of the invention provides a low cost means of batch filling.

The viscous liquids can be dispensed at refrigeration temperatures by the use of the invention. Thus, heating the liquid to lower the viscosity is not necessary. So, the degradation of the compound that would accompany heating is avoided by the invention.

Exemplary of viscous liquid drugs for which the apparatus of the invention is particularly well suited are $\alpha$-tocopheryl-acetate and boldenone undecylenate.

The apparatus of the invention is useful in dispensing these drugs into ampules for use as reference standards.

DETAILED DESCRIPTION OF THE INVENTION

An embodiment of the syringe dispensing filler apparatus in accordance with the invention will now be described with reference to FIGS. 1 and 2.

Figure 1:
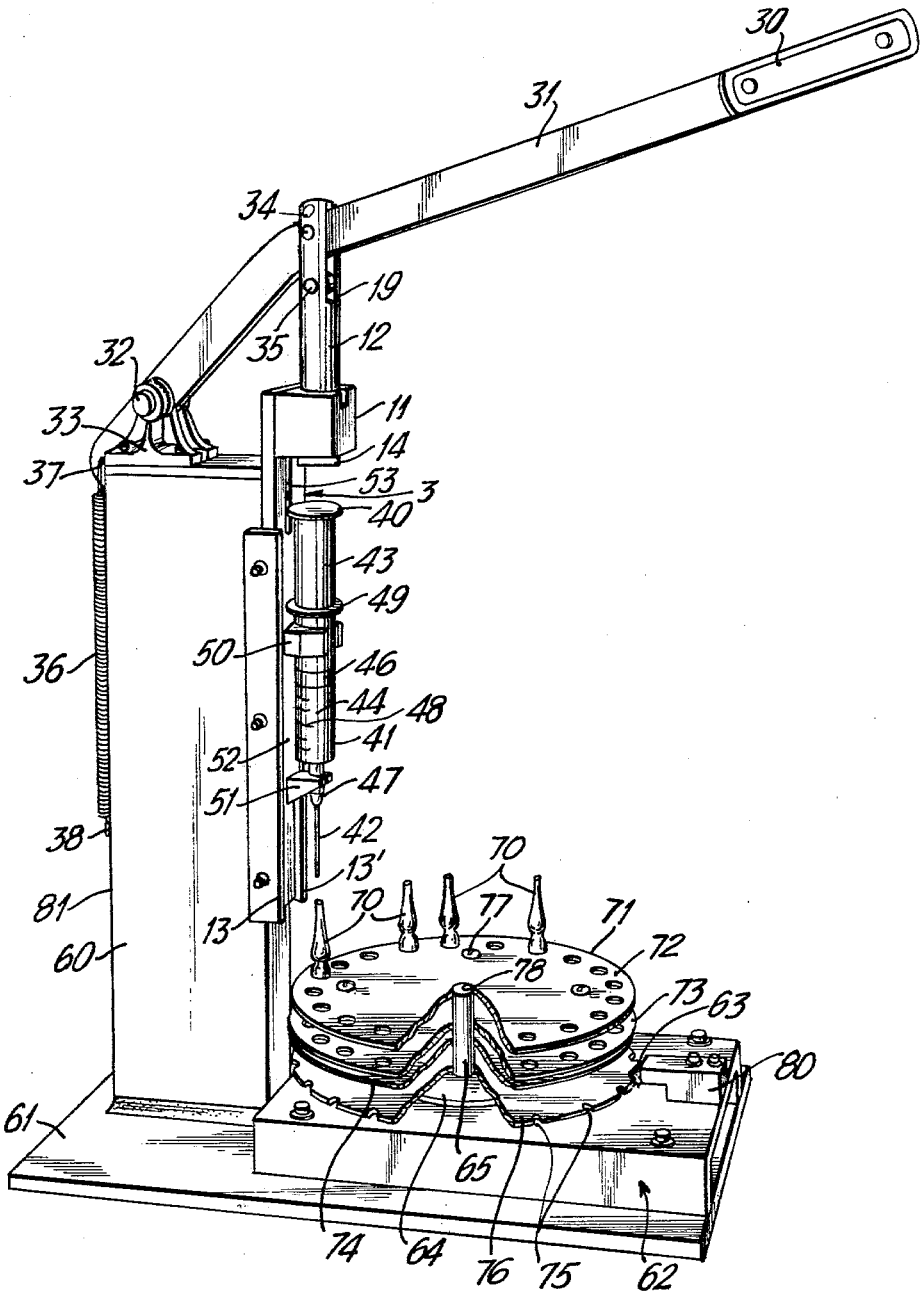
FIG. 1 is a perspective view of the apparatus of the invention with a phantom section in the turntable holder to show the spindle and turntable stand.
Figure 2:
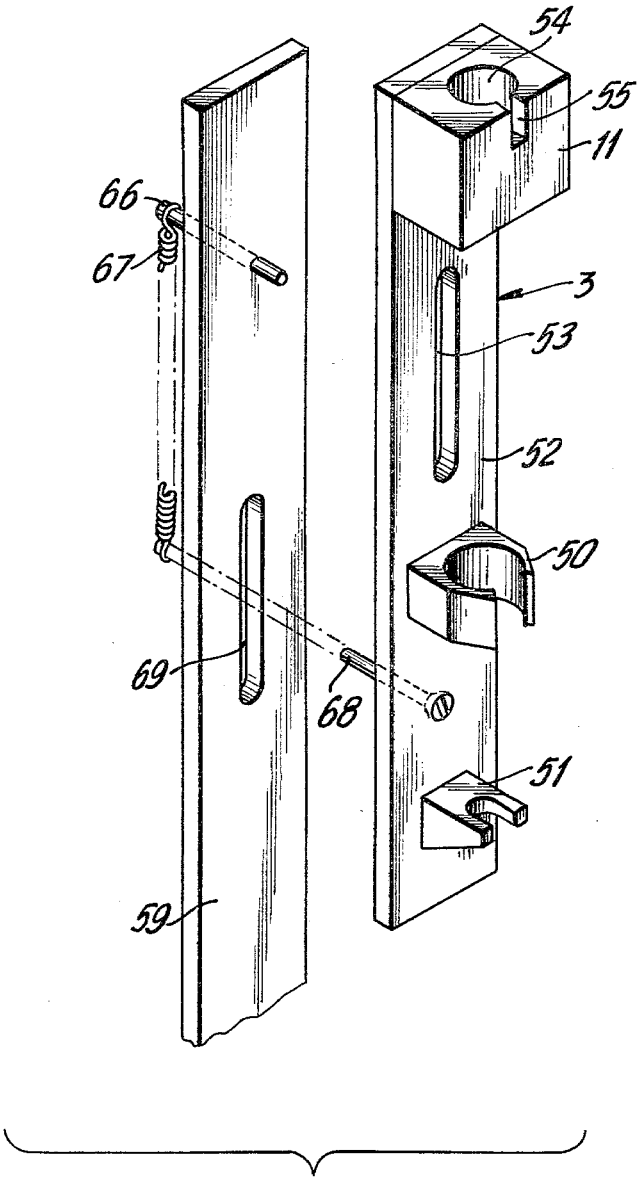
FIG. 2 is an exploded view of the syringe holder slide assembly.

Noting FIG. 1, the apparatus referred to generally as 1, comprises a base 61 supporting a filler housing 81 which supports syringe holder slide assembly 3 and return handle. FIG. 2 shows the syringe holder slide assembly 3 in detailed relation to housing side wall 59 of the filler housing.

To fill an ampule 70, the operator holds the handle grip 30 of the return handle in his hand and forces it down. The handle grip 30 is connected to the pivoted bar 31 and spring 36. The pivoted bar 31 pivots on a pivot pin 32. The ends of pivot pin 32 are supported by bracket 33. The pivoted bar 31 passes between upper and lower clevis pins 34 and 35 and through the plunger clevis 19. The tip of pivoted bar is anchored to the housing 81 by spring 36.

When the operator forces the pivoted bar 31 down by pressing on the handle grip 30, the (handle) plunger 12 is moved downwardly. As the plunger 12 moves downwardly it passes through the plate head 11 until the enlarged plunger member 14 engages the upper end of the syringe handle 40. The syringe cylinder 41 is held by syringe support 51 and syringe holder clamp 50. Syringe holder clamp 50 and syringe support 51 are welded to the vertical plate 52 of the syringe holder slide assembly 3. The syringe holder slide assembly 3 held internally to the housing by spring and is guided in its motion by two guides 13 and 13'. The guide 13 is attached to side wall 60 of the filler housing. Similarly, the guide 13' is attached to the opposite side wall of the filler housing. The sidewall 60 and the remaining filler housing is attached to the base 61. The turntable base 62 is attached to the base 61 of the filler housing. The indexing spring loaded ball 63 is retained by ball housing 80 which is attached to the turntable base 62. The turntable spindle 65 is attached in the center of the turntable stand 64. The turntable stand 64 is attached to the turntable base 62.

As the operator pushes down on the grip handle 30, the plunger first comes in contact with the upper end of the syringe handle 40 then as the operator continues to force the handle grip 30 downwardly, the syringe shaft 43 is forced down. The syringe handle 40 is attached to the syringe shaft 43. The syringe shaft 43 is attached to piston plug 46. Piston plug 46 makes fluid tight contact with the syringe cylinder 41. The syringe cylinder 41 is clamped to the syringe cylinder holder clamp 50. Its bottom sits on the syringe support 51. The syringe cylinder holder 50 and syringe support 51 are part of the syringe holder slide assembly 3. Thus, when the plunger 12 engages the upper end of the syringe handle 40, it pushes on the syringe 49, and the syringe holder 50, which is attached to syringe holder slide assembly 3, so that the entire slide assembly 3 and the syringe 49 are both moved downwardly. This downward motion continues for the length of the slots 53 in the vertical plate 52 and housing sidewall 59 respectively. When the stationary pin 66 is reached by the upper end of the slot 53, the syringe holder slide assembly 3 is stopped from moving further. At this point, the syringe needle 42 has been inserted down the neck of the ampule 70. The plunger 12 continues to move down but the slide assembly 3 remains stationary and the plunger 12 forces the syringe shaft 43 and plug 46 against the liquid 44 in the cylinder chamber 41 at the lower end. The liquid is thus forced through the syringe needle 42 into the ampule 70.

The operator then stops forcing the handle grip 30 downwardly. The spring 36 of the pivot bar 31 pivots the bar up pulling the handle plunger 12 in an upwardly direction. The plunger member engages to the head 11 pulling the syringe holder slide assembly plate upwards. Then the syringe holder slide assembly is then forced upwardly by spring 67. Spring 67 is attached at its upper end to pin 66 and at its lower end to bolt 68. Bolt 68 is guided by slot 69. Slot 69 is in the housing side wall 59, which is adjacent moveable vertical plate 52. When bolt 68 reaches the upper end of slot 69, the syringe holder slide assembly 3 is stopped from its upward motion. When the bolt 68 reaches the upper end of slot 69, the needle 42 of the syringe has been removed from the neck of the ampule 70. Spring 36 is attached at its upper end to a hole 37 in the pivoted bar 31. Spring 36 is attached at its lower end to hook 38. The hook 38 is attached to the side wall of the filler housing 81.

The turntable ampule holder 71 has four plates: upper plate 72, middle plate 73, lower plate 74 and positioning plate 76. Upper plate 72 and middle plate 73 have apertures of a diameter suitable for holding ampules. The axis of the aperture of upper plate 72 and middle plate 73 are coaxial. Lower plate 74 is substantially solid. Positioning plate 76 is substantially solid with peripheral semicircular indexing holes 75. The holes 75 engage the spring loaded ball 63 to hold the turntable in position under the syringe needle so that the syringe needle is aligned with the ampule being filled. The ball 63 is held in its housing 80. A compressed spring (not shown) in ball housing 80 protrudes the ball 63 that locks the holes 75. Each of the plates 72, 73, 74 and 76 has of central aperture 78 adapted to receive spindle 65. The plates 72, 73 and 74 are attached to support columns 77 which are supported by and attached to positioning plate 76.

The turntable stand 64 is preferably made of a low surface friction polymer such as polyethylene, so that the turntable ampule holder 71 slides easily on turntable stand 64.

The channel 54 in head 11 guides the up and down movement of the plunger 12. The groove 55 in head 11 seats the pivoted bar 31 when plug 46 is low in the syringe cylinder 41.

After each ampule 70 is filled, the operator rotates the turntable 71 until the next ampule is under the needle 42. At this position the ball 63 engages a hole 75 to hold the turntable in position. The operator may force down on the grip 30 to start filling the next ampule as described above.

When the ampules are filled on the turntable, the operator may remove the turntable 71 from the spindle 65 and place it on an automatic flame sealing device such as The Ampulmatic TM made by Oceanography International Corporation which automatically seals the glass by melting the top of the ampule with an oxygen/-propane flame forming a seal.

The needle 42 has a central channel which is open at the top and bottom for fluid flow communication with liquid 44 in the syringe cylinder chamber 41 and the ampule 70.

Other advantages and modifications to the specific embodiment shown above will be obvious to those skilled workers in the art.

While this invention has been described with reference to the specific embodiments disclosed herein, it is not confined to the details set forth and the patent is intended to include modifications and changes which may come within and extend from the following claims.

What is claimed is:

1. An apparatus for holding a syringe and filling an ampule comprising:

(a) a housing having a base and a vertical support member;

(b) a syringe holder comprising a plate which is slideably mounted on said vertical support member, said syringe holder including means for holding a syringe and means for preventing said syringe from sliding downward in said syringe holder in response to a downward force applied to the shaft of the syringe, said syringe holder further comprising a head member at its upper end, said head member being adapted to slideably retain the end of a plunger;

(c) vertical limit means for limiting the upward and downward vertical movement of said syringe holder on said vertical support member;

(d) spring return means for biasing said syringe holder at its upper vertical limit on said vertical support member;

(e) a bar which is pivotally mounted at the top of said vertical support member, said bar having a handle grip at one end;

(f) a plunger for applying a downward force onto said syringe shaft, the top of said plunger being suspended from, and slideably mounted on, said bar between said handle grip and said pivotal mounting, the bottom of said plunger being slideably mounted through, and retained by, said head member of said syringe holder;

(g) spring return means for biasing said handle grip upward, whereby, when said handle grip is moved downward, said plunger slides through said head member, contacts the shaft of said syringe, and forces said syringe holder to slide down said vertical support member against the force of said spring return means until said syringe holder reaches its lower vertical limit when additional downward force on said handle grip causes said plunger to push said syringe shaft into said syringe, thereby forcing the contents of said syringe to be dispensed.

2. The apparatus of claim 1 further comprising ampule holding means which holds an ampule under said syringe holder, whereby the needle of said syringe will be inserted into an ampule in said ampule holding means when said syringe holder slides down said vertical support member.

3. The apparatus of claim 2 wherein said syringe holder comprises a slide assembly including a fixed syringe support through which the needle, but not the cylinder, of the syringe will fit.

4. The apparatus of claim 3 wherein said syringe holder further comprises a syringe holder clamp for holding the cylinder a syringe.

5. The apparatus of claim 4 wherein said syringe holder clamp is comprised of a spring clamp which grips the cylinder of a syringe inserted therein.

6. The apparatus of claim 2 wherein the vertical limit means comprises a slot formed in said plate of said syringe holder and a pin projecting through said slot from said vertical support member, whereby said holder means can slide up and down on said vertical support member for a distance substantially equal to the length of said slot.

7. The apparatus of claim 2 wherein said ampule holding means comprises a turntable mounted on said base, said turntable rotating in a horizontal plane around a central vertical axis, there being a series of vertically aligned, ampule receiving wells formed in said turntable.

8. The apparatus of claim 7 wherein said turntable is comprised of an upper plate and a middle plate, each of said plates having coaxially aligned aperatures formed therein of a diameter suitable for holding ampules, said turntable further comprising a substantially solid lower plate on which said ampules rest.

9. The apparatus of claim 8 wherein said turntable further comprises a positioning plate beneath said lower plate, said positioning plate being substantially solid and having a series of semicircular indexing holes formed on the periphery thereof, each of said indexing holes being substantially aligned in fixed angular relationship with one of said ampule holding aperatures, said apparatus further comprising a spring loaded ball in a housing on said base, said ball and said indexing holes being adapted to act as a detent, whereby, each time said ball enters one of said indexing holes, one of said ampule holding aperatures will be aligned in a position to receive a needle from a syringe in said syringe holder.

10. The apparatus of claim 9 further comprising a turntable stand on which said turntable rotates, said turntable stand being made of a low friction material.

* * * * *